US006254216B1

(12) United States Patent
Arway et al.

(10) Patent No.: US 6,254,216 B1
(45) **Date of Patent: *Jul. 3, 2001**

(54) CLEAN-IN PLACE SYSTEM FOR AN INK JET PRINTHEAD

(75) Inventors: George Arway, Norridge; Frank Eremity, Streamwood; George Murad, Bartlett, all of IL (US)

(73) Assignee: Marconi Data Systems inc., Wood Dale, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/162,611

(22) Filed: Sep. 29, 1998

Related U.S. Application Data

(63) Continuation-in-part of application No. 08/886,370, filed on Jul. 1, 1997, now abandoned.

(51) Int. Cl.[7] ..... B41J 2/165
(52) U.S. Cl. ..... 347/28; 347/29
(58) Field of Search ..... 347/26–28, 29, 347/25, 30

(56) References Cited

U.S. PATENT DOCUMENTS

| | | | |
|---|---|---|---|
| 4,425,934 | 1/1984 | Scheffer | 132/223 |
| 4,591,870 | 5/1986 | Braun et al. | 342/28 |
| 5,459,497 | 10/1995 | Manning et al. | 342/80 |
| 5,753,049 | 5/1998 | Ihara et al. | 347/28 |
| 5,825,380 | 10/1998 | Ichizawa et al. | 347/28 |

FOREIGN PATENT DOCUMENTS

| | | | | |
|---|---|---|---|---|
| 000361393 | * | 4/1990 | (EP) | 347/25 |
| 0 424 008 | | 4/1991 | (EP) . | |
| 002618728 | * | 2/1989 | (FR) | 347/28 |
| WO 093017867 | * | 9/1993 | (GB) | 347/28 |
| 57-27757 | * | 2/1980 | (JP) | 347/28 |
| 355109666 | * | 8/1980 | (JP) | 347/28 |
| 57-27757 | | 2/1982 | (JP) . | |
| 58-42467 | * | 3/1983 | (JP) | 347/29 |
| 58-194577 | | 11/1983 | (JP) . | |
| 60-023048 | | 2/1985 | (JP) . | |
| 63-087241 | | 4/1988 | (JP) . | |
| 4-039055 | | 2/1992 | (JP) . | |
| 4-53753 | * | 2/1992 | (JP) | 347/28 |
| 04053753 | | 2/1992 | (JP) | 347/28 |
| 07089092 | | 4/1995 | (JP) | 347/28 |
| 7-314703 | | 12/1996 | (JP) . | |

* cited by examiner

*Primary Examiner*—N. Le
*Assistant Examiner*—Lamson D. Nguyen
(74) *Attorney, Agent, or Firm*—Piper Marbury Rudnick & Wolfe

(57) ABSTRACT

A clean-in-place system for use in an ink jet printhead has a compartment and an end plate with a slot therein to permit ink drops to be projected from the compartment onto a substrate to be marked. For cleaning purposes, a shutter is disposed adjacent the slot to seal it. Thereafter, the pump floods the compartment with ink solvent from a solvent reservoir. The solvent may be agitated by air or a mechanical device. Thereafter, a drain line is used to remove the solvent from the compartment. The pneumatic shutter is reopened after the solvent is withdrawn to enhance the drying of the components. The shutter may consist of an inflatable member and a pump for supplying compressed air to the inflatable member to inflate and deflate it.

26 Claims, 6 Drawing Sheets

CLEAN-IN PLACE SYSTEM FOR AN INK JET PRINTHEAD

CROSS REFERENCE TO RELATED APPLICATIONS

This application is a continuation-in-part of U.S. application Ser. No. 08/886,370 filed Jul. 1, 1997 now abandoned.

BACKGROUND OF THE INVENTION

This invention relates to ink jet printing in general and to continuous jet printers in particular. Such devices are well-known in this art and are used in industrial and commercial applications to print indicia on various product surfaces which are usually moving on a conveyor system. The indicia may contain useful information such as date codes, plant identification information and the like. Such printers are subject to long periods of continuous use and must be highly reliable. Nevertheless, at periodic intervals, it is necessary to clean the printhead which is usually located a distance from the printer electronics and ink supply. The printhead is connected to the printer system by an umbilical cord which contains the electronics, ink supply and ink return lines.

In continuous ink jet devices high voltage is used to electrostatically deflect charged ink drops onto the substrate to be marked. Uncharged drops are directed to a gutter which returns them to the ink reservoir for reuse. Typical ink jet systems of this type are disclosed in U.S. Pat. No. 3,683,396 assigned to the present assignee. Over time, the ink drops generate small particles, or ink mist, which when combined with dust, et cetera, may be electrostatically attracted to the high voltage deflection plates, charge electrode and related components contained within the printhead. This results in unwanted build up on the printhead components and, over time, degrades the quality of the printing by distorting the electric field, impeding the projection of the drops or causing the drops to be misdirected. For this reason, the printhead must be cleaned periodically.

Presently, when an ink jet printer is shut down at the end of a shift, or displays degraded printing operation, the printhead is manually disassembled and cleaned. This requires a skilled operator who removes the printhead cover and usually places the printhead mechanism consisting of a nozzle, charge electrode, deflection electrodes and gutter assembly in a special cleaning tray. He then sprays the printhead with a compatible solvent for cleaning, removes the solvent and dissolved ink and then drys the components, either by manually wiping them or blowing compressed air on them. Obviously, this manual operation is labor intensive, requiring skilled personnel to accomplish the task in a miniaturized, highly specialized electronic component and disposal of contaminated cleaning solvent. Incorrect cleaning techniques can lead to damage to the printhead or improper printing operation.

According to the invention, the need for manual cleaning is eliminated. Cleaning of the printhead components is accomplished automatically, in place, without disassembly of the printhead. This avoids exposing the technician to the hazardous fluids and the printhead remains sealed protected from handling damage and the environment which may exist at the point of its use. Furthermore, the automatic cleaning system of the present invention is relatively low in cost and requires little modification to existing printhead designs.

It is accordingly an object of the present invention to provide an automatic cleaning system for an ink jet printhead which eliminates the need for manual disassembly and cleaning of the printhead components.

It is a further object of the invention to provide a printhead which includes means for sealing and unsealing the printhead aperture through which ink normally exits to permit the printhead to be flooded with cleaning fluid (solvent). Solvent may then be introduced to the printhead and agitated either mechanically or with air to ensure contact of the solvent with dried ink and dust which may be deposited on the components. Thereafter the solvent is removed along with the material dissolved therein, all without the need for disassembling the printhead.

It is a further object of the invention to provide an ink jet printhead shutter which may be pneumatically operated to seal and unseal the printhead opening through which ink normally exits.

It is a further object of the invention to provide a printhead which can be selectively sealed so that a cleaning fluid can be introduced therein to clean the components. These and other objects of the invention will be apparent from the remaining portion of the specification.

SUMMARY OF THE INVENTION

A printhead structure includes an end plate at one end having a slot through which ink may be ejected during normal operation. Components including electrical parts are contained in the printhead behind the slot and within a sealable compartment. These components include a nozzle face, a charge electrode which applies a charge to selected ink drops exiting the nozzle, deflection electrodes and the collector for uncharged drops. In operative relation to the slot through which drops leave the printhead is a pneumatically inflatable tube or membrane. During normal operation of the printhead, the tube is deflated. For automatic cleaning, the tube is inflated, hermetically sealing the slot. Cleaning fluid such as make-up ink solvent is directed into the printhead compartment where it floods the components contained therein. Thereafter, mechanical vibration or air pressure can be used to agitate the cleaning fluid to ensure effective removal of dried ink which, over time, accumulates on the printhead components. Thereafter, the cleaning fluid is removed from the printhead via drain lines after which the tubular member is deflated. The printhead may then sit idle until the components therein are dry. Heated or unheated air may be introduced, or an electric strip heater may be used, to expedite drying of the components. Normal printing operation may resume thereafter.

DETAILED DESCRIPTION

Figure 1A:
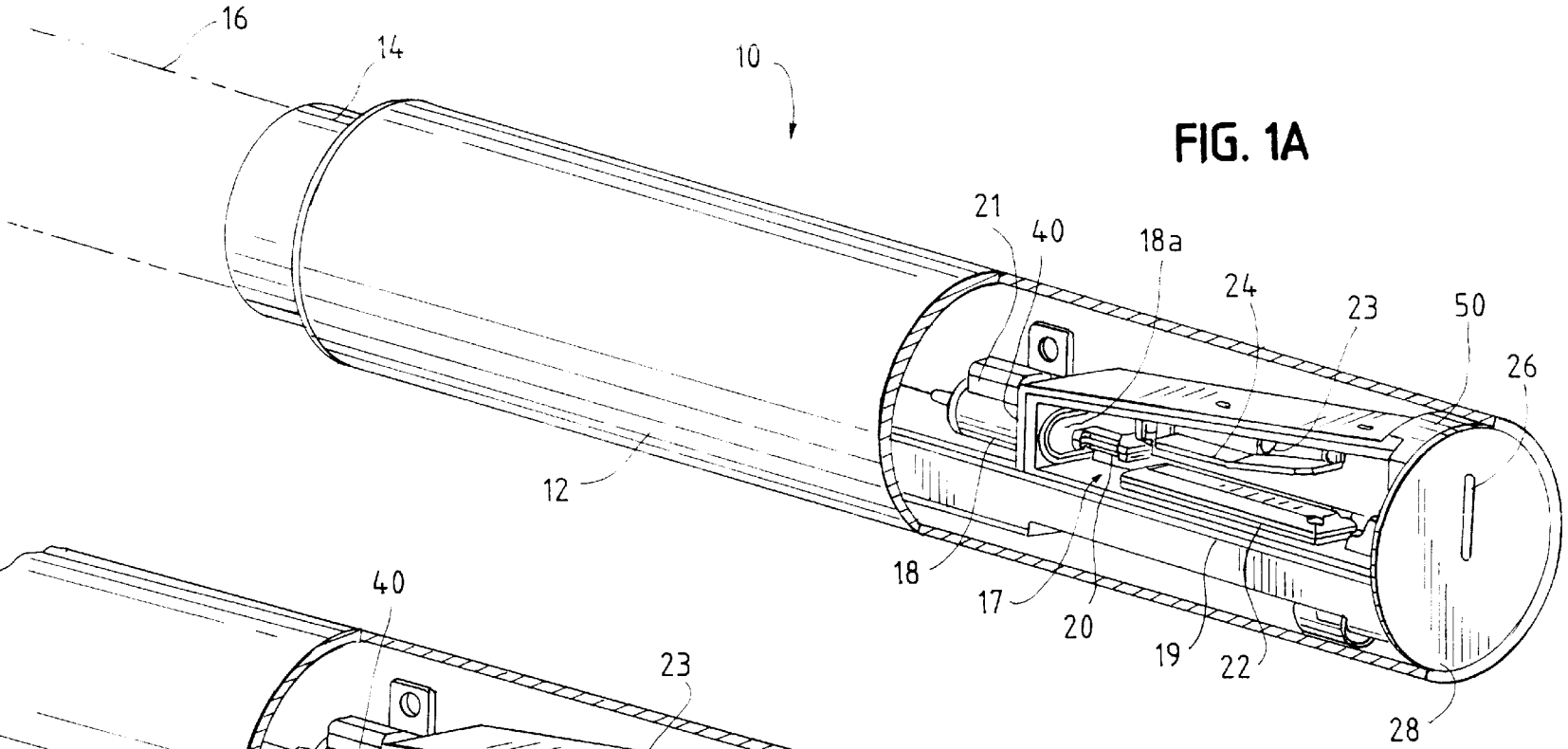
FIG. 1A is a perspective view, partially cut away, of an ink jet printhead of the type for which the present invention in suited and on which the inflatable tube is installed.

As indicated in the background portion of this specification, it is important to periodically clean the components of a printhead to remove dried ink which eventually forms on the various components contained therein. This requirement is in addition to the requirement to periodically purge the nozzle, ink catcher, and the ink return line to remove dried ink which builds up therein. With respect to the nozzle, the ink return line and catcher, there exists various cleaning procedures such as that used by the present assignee referred to as Auto Flush. The present invention is intended for use after an Auto Flush operation and is in addition to such operation.

Auto flush, which is available for Videojet EXCEL® printers manufactured by the present assignee, permits the printer to automatically flush the nozzle catcher and ink return line in the printhead whenever the printer is shut down. This reduces printer maintenance. In the Auto Flush procedure, a printer pumps approximately two milliliters of pressurized solvent or make-up fluid through the printhead nozzle to the catcher for approximately sixty seconds. This thoroughly cleans the nozzle and ink return line in the printhead, reducing problems which may occur when restarting the printer due to ink drying inside the nozzle or the ink return line. Details of the Auto Flush procedure and the system associated therewith may be found in the Videojet Manual entitled "Addendum for EXCEL **170*i*** Printer with Auto Flush, Part Number 365293-01-A, dated August 1994.

The present invention is intended as an adjunct to the Auto Flush process for the purpose of cleaning the components of the printhead in addition to the nozzle, catcher and return line. By printhead components, it is meant in particular, the outside surfaces of the nozzle, the charge electrode used to charge the ink drops as they break off from the ink stream, the deflection electrodes used to deflect charged drops projected through the slot or aperture provided in the end plate and the outside surfaces of the gutter or return through which unused drops are cycled back to the ink supply. It is these components which, over time, accumulate dried ink on the surfaces which may interfere with the proper formation and deflection of ink drops onto the surfaces to be marked. These components are not cleaned by the Auto Flush procedure. Heretofore, it has been necessary for a technician to manually disassemble the printhead by taking the printer out of service, removing the printhead cover and manually applying solvent to the components, usually in a lab tray or similar container. Thereafter, the components must be dried and the printhead reassembled before the printer can be placed back in service.

The present invention eliminates the need for manual intervention and provides the high quality printing over an extended period of time. The printhead component compartment is automatically sealed and unsealed. The compartment is then flooded with solvent. Thereafter the solvent is removed and, preferably, the components dried. Thereafter the printhead may be returned to service.

When it is desired to clean the printhead, the Auto Flush process is first used to clean the nozzle and return lines. Thereafter, the disclosure of the present invention is employed to clean the printhead components. Preferably, the Auto Flush solvent system is used to supply solvent through the nozzle orifice to the sealed printhead compartment for purposes of the present invention. Alternatively, solvent is simply directed through the nozzle into the printhead compartment. More specifically, upon ink jet printer shut down, the drop exit or slot is shuttered closed by using a pneumatic membrane or tube. Solvent is then supplied via the nozzle orifice from the Auto Flush system to fill or partially fill the compartment. Preferably, compressed air is then introduced into this compartment to bubble stir and otherwise agitate the solvent over the surfaces of the components to be cleaned. After a predetermined cleaning time, the solvent is drained from the printhead via drain/vent lines. Preferably, the drained solvent is cycled back to the ink system for use as make-up solvent during the printing process. This reduces waste and eliminates the need for disposal of this material. The printing slot is then opened by deflating the pneumatic tube.

The printhead may sit idle for a period of time to allow the components therein to dry. Heated or unheated compressed air may also be introduced into the printhead through an air line to more quickly dry the components. Alternatively, an electric strip heater may be positioned within the printhead. After the components have dried, the printhead is then ready to be returned to printing.

Figure 1B:
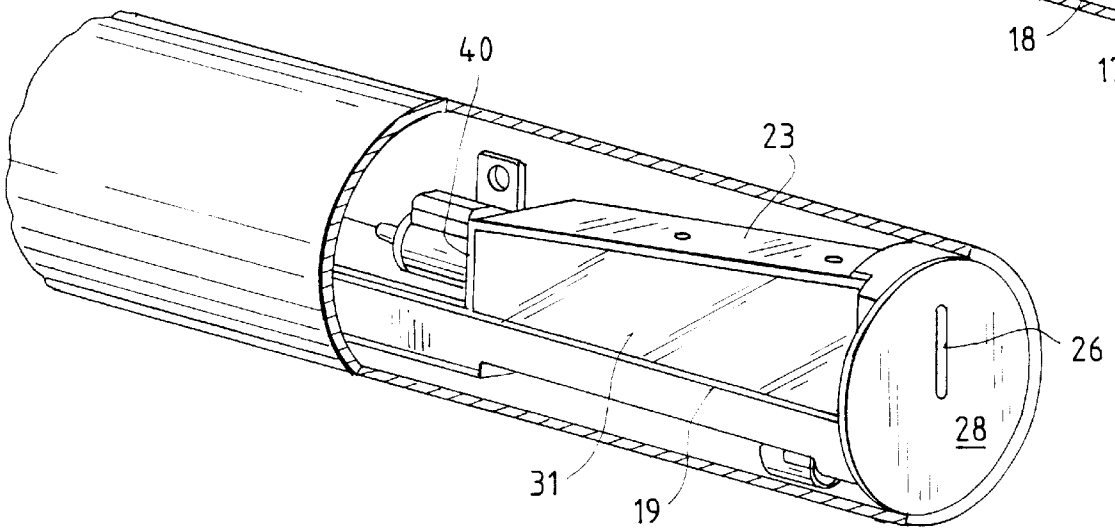
FIG. 1B is a perspective view, partially cut away, of a portion of the ink jet printhead of FIG. 1A with the removable sidewalls in place.
Figure 2:
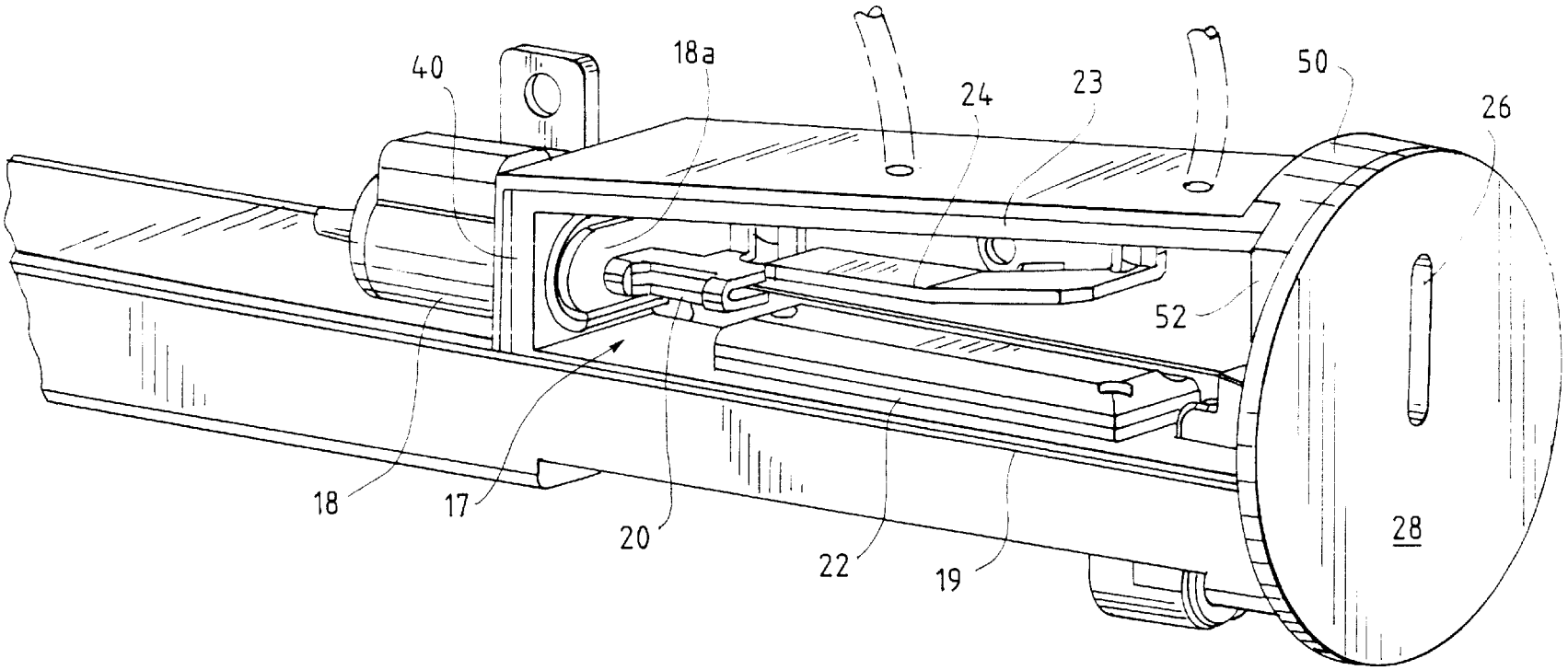
FIG. 2 is an enlarged perspective view similar to FIG. 1A, but with the printhead cover removed.
Figure 3:
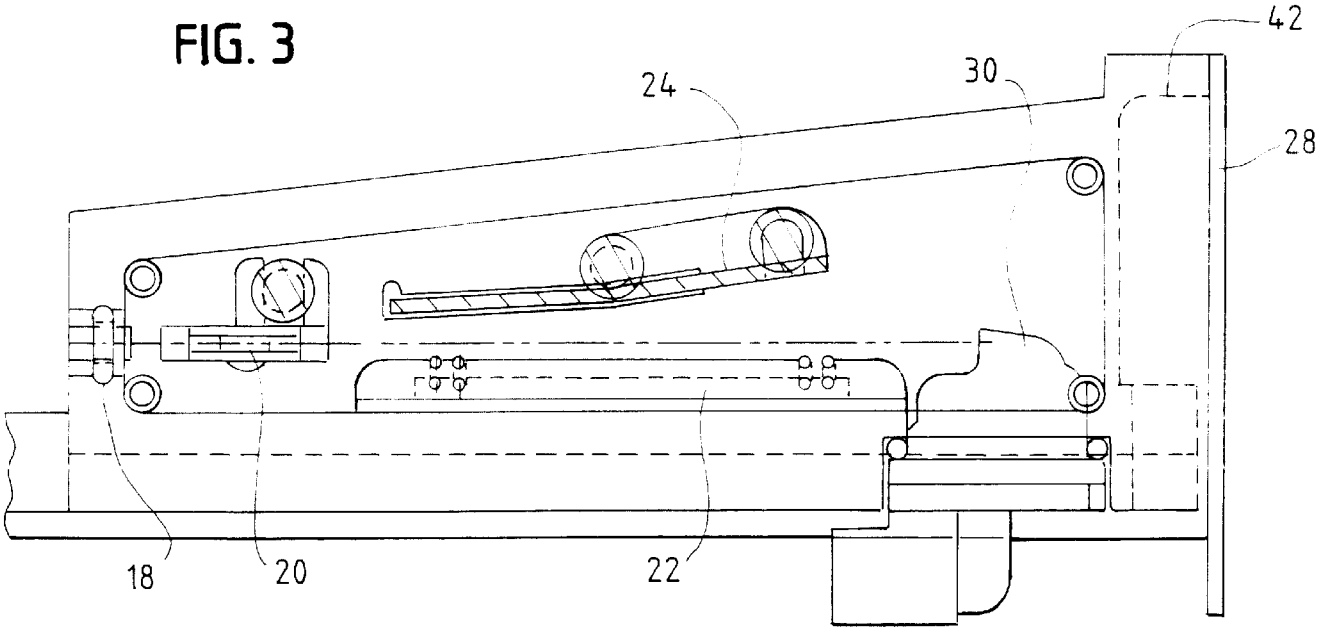
FIG. 3 is a side elevational view of the printhead illustrating the positioning of the inflatable tube relative to the end plate exit slot.

Referring to FIG. 1A, there is shown a printhead 10 modified in accordance with the present invention. The printhead includes a cover 12 which is removably secured to the manifold 14 which couples to an umbilical cord 16 (shown in phantom) which contains the electrical lines, ink supply and return lines for normal operation of the printhead. Shown through a cut-away portion are the printhead components of interest contained in a compartment 17. These components include a nozzle face 18*a*, a charge electrode 20, deflection electrodes 22 and 24 and an exit slot 26 through an end plate 28. Not shown clearly in FIG. 1A is the ink catcher 30 which is shown in FIG. 3. The compartment 17 is defined by the backing members 19 and 23 for the deflection electrodes 22 and 24; a bulkhead 40; the end plate 28; and, as illustrated in FIG. 1B, sidewalls 31. The sidewalls have been omitted from FIGS. 1A, 2 and 3 for clarity.

As known to those skilled in this art, ink is supplied to the nozzle 18 under pressure. It exits the nozzle through a small orifice as a stream of ink. A piezoelectric transducer 21 positioned inside the nozzle housing, or similar mechanical device, applies a stimulation voltage to the nozzle causing the ink stream to break up into a series of discrete droplets as the stream passes through the charge electrode 20. Selected drops are charged and thus, when they pass the deflection electrodes 22 and 24 are deflected from their normal path of flight upwardly so as to pass through the slot 26 and onto a surface to be marked. As shown in FIG. 3, uncharged drops that are not deflected, pass directly to the catcher 30 which returns these drops to the ink supply for further use.

For purposes of the present invention, it is desired that these principal components used in ink jet printing be contained within the printhead compartment 17, which can be sealed for flooding with solvent. This can be better appreciated in FIG. 2 which is an enlarged view of a portion of FIG. 1A. It will be appreciated that, with the removable sidewalls 31 in place, as illustrated in FIG. 1B, the components 20, 22 and 24 are completely sealed on one end by the end plate 28, on the other end by the bulkhead 40 and on the top and bottom portions thereof, by the supporting structure to which they are mounted. Thus, except for the catcher 30 and the slot 26, there is no access to these components.

According to the present invention, when it is desired to clean the components in the compartment 17, the slot 26 is sealed and solvent is introduced to at least partially flood the components. Thereafter mechanical agitation or air is used to agitate the solvent to cause it to fully contact the surfaces of the components to dissolve and thereby remove dried ink, dust and anything else which may have dried on the components. Thereafter, the solvent and the dissolved material are removed and slot 26 is reopened so that printing may resume.

Figure 4B:
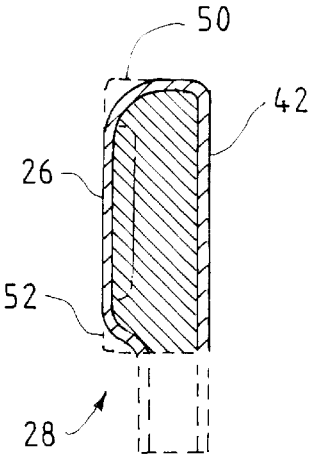
FIGS. 4A and 4B show the exit slot open and closed, respectively, depending upon the state of pressurization of the inflatable tube.
Figure 4A:
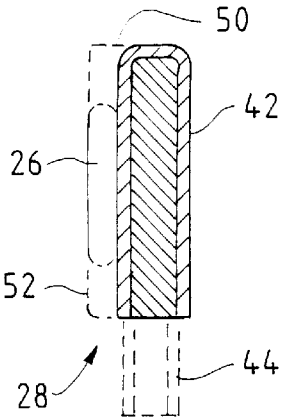

Referring to FIGS. 4A and B, the manner in which the slot 26 is sealed and unsealed is illustrated. FIG. 4A illustrates slot 26 in the normal, open condition wherein ink drops can pass out of the slot. Positioned adjacent the slot in proximity to end plate 28 is a pneumatic shutter in the form of an inflatable tube 42, the lower end of which is connected to a conduit 44 for providing a source of air pressure thereto. The inflatable tube 42 is also shown in FIG. 3 in relative position against the end plate 28.

In FIG. 4B, tube 42 is shown in the inflated condition in which air pressure has caused it to expand sufficiently to completely seal the slot 26. In this position, the printhead compartment 17 containing the charge electrode, deflection plates, nozzle face and catcher are completely sealed (except for the catcher ink return line and the drain/vent lines described in connection with FIG. 5). As indicated by dashed lines in FIGS. 4A and 4B, walls 50 and 52 perpendicular to the end plate are preferably provided so that, as shown in FIG. 4B, when the tube is inflated, its configuration is confined by the walls to ensure hermetic sealing of the slot 26. Although a pneumatic shutter is preferred, other forms of shutter could be used. For example, a spring biased or electronic shutter is satisfactory if space and cost permit. It is simply necessary that the shutter be capable of hermetically sealing the chamber during the cleaning process.

From the foregoing, the manner of operation of the invention will be apparent. For completeness, however, FIG. 5 discloses a schematic circuit diagram of the typical ink jet valves and supply lines used in conjunction with the present invention including those which have been added for carrying out the invention. A consideration of FIG. 5 in connection with the following description will fully indicate the manner of operation. After the printer has been taken off-line it is desired to Auto Flush and then clean the printhead. The following steps are employed. An electric valve 101 is energized to supply compressed air from a compressed air source to inflate and thereby close the pneumatic shutter or tube 42 via line 102. A pump 103, designated the Auto Flush pump is then activated to pump make-up fluid or solvent through line 104 and flush valve 105 to the nozzle 18. The stream or jet of solvent 107 passes through the printhead and enters the catcher 30 where it is drawn back to the ink reservoir 109 via line 110 and valve 111 which is connected to a vacuum source by valve 121.

After a predetermined time, pump 103 is turned off and conduit 110 is allowed to evacuate. After a further predetermined time period, the valve 121 is de-energized to remove the vacuum from valve 111. This closes valve 111 and removes vacuum from conduit 110 and the catcher 30. This completes the Auto Flush sequence.

To initiate the printhead cleaning sequence, pump 103 is again activated to push additional make-up fluid through conduit 104, valve 105 and nozzle 18. This time, however, valve 111 is closed so that the fluid cannot pass into the ink catcher 30 and return line 110. Instead, the compartment 17 in which the printhead components are located is flooded with the solvent, either partially or fully. When the printhead compartment 17 is filled with the desired amount of solvent, the pump stops and agitation begins. According to a preferred embodiment, agitation is accomplished by using valve 113 to direct compressed air through conduit 114, via a flow restrictor 115, into the printhead compartment 17. This causes agitation of the make-up fluid in the chamber. The air which enters the chamber is vented to the atmosphere through either conduits 116 or 117 (depending on the orientation of the printhead), both of which lead to a solvent trap 118 and to atmosphere via conduit 119 and valve 120. The solvent trap 118 retains liquid which may be entrained as the air is vented.

After a predetermined time, valve 113 is closed and valve 120 is operated to apply a vacuum to the solvent trap 118 via conduit 119. This removes the make-up fluid in the chamber 17 via conduit 116 or 117 (again depending upon the orientation of the printhead) into the solvent trap 118 which recycles the solvent thus captured back to the ink reservoir. The recovered solvent is used to replace solvent lost during printing through evaporation. The solvent in the trap 118 is displaced by operation of valve 123 which controls valve 125 to permit solvent to flow from the solvent trap 118 through the float valve 126, filter 127, valve 125, conduit 128 into the ink reservoir 109.

After the solvent has been removed from the printhead compartment 17, it is preferred, but not required, to dry the components. For that purpose, valve 120 is de-energized, again venting the compartment 17 to atmosphere. Valve 101 is also de-energized, opening the pneumatic shutter by deflating the tube 42. Valve 111 may be opened for a short time prior to drying the printhead. This decreases the printhead drying time by removing any solvent that may be remaining in the mouth of the catcher 30.

Figure 5:
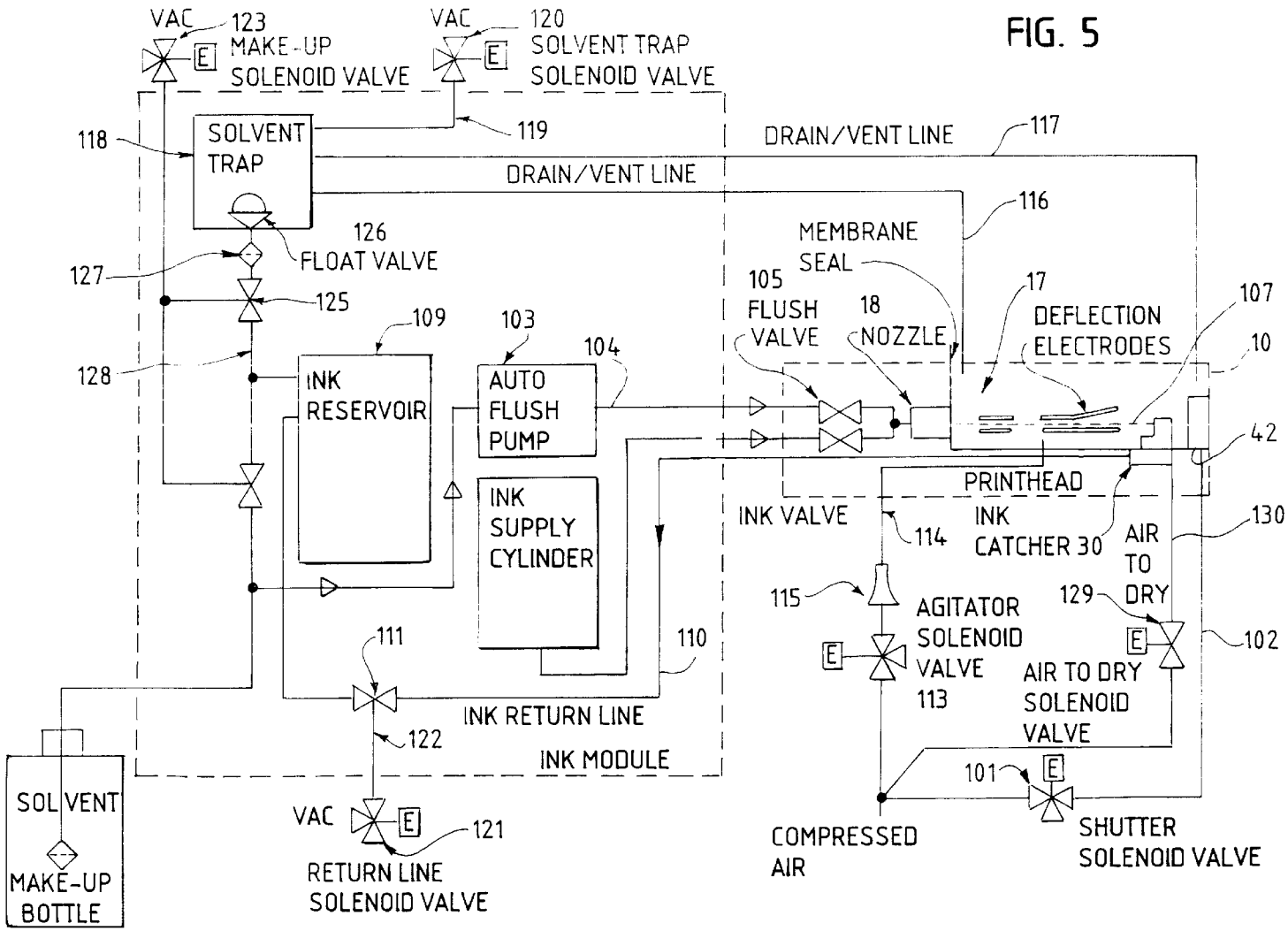
FIG. 5 is a schematic diagram of the various valves and supply lines used to accomplish the automatic cleaning procedure according to the present invention.

The components within the printhead compartment 17 may be dried using a variety of techniques. For example, the printhead 10 may sit idle until the components are dry. A valve 129 may also be provided, as shown in FIG. 5. When valve 129 is energized, compressed air flows through conduit 130 to the printhead compartment 17. This air flow quickly dries the components inside the compartment 17. After a predetermined time, valve 129 is de-energized to shut off the compressed air. Alternatively, the drying step may be omitted. The equipment is simply returned to use after a period sufficient to allow the excess solvent to evaporate.

Figure 6:
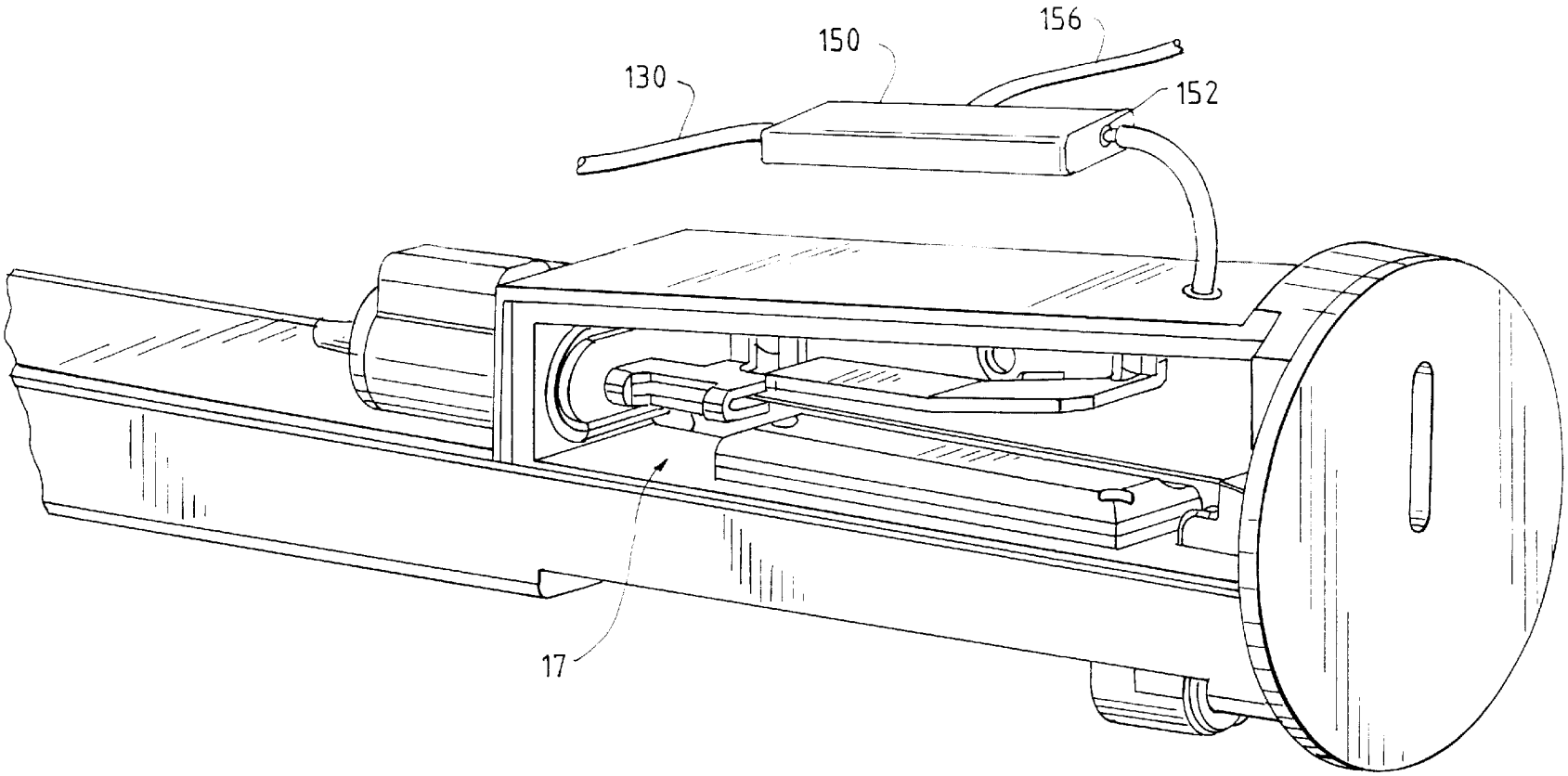
FIG. 6 is a perspective view of the ink jet printhead of FIG. 2 with an air heating unit installed.

To further expedite drying, an air heating unit, as shown at 150 in FIG. 6, may be added to conduit 130. Air heating unit 150 contains heating elements surrounding an air passage 152 that is in communication with conduit 130. For example, air heating unit 150 could contain wire heating elements wrapped around passage 152. Air heating unit 150 is preferably powered by electricity which is provided from a power source (not shown) through wires 156. When valve 129 is energized, compressed air travels through air passage 152 via conduit 130. As a result, heated air enters compartment 17 so that the components therein are rapidly dried.

Figure 7:
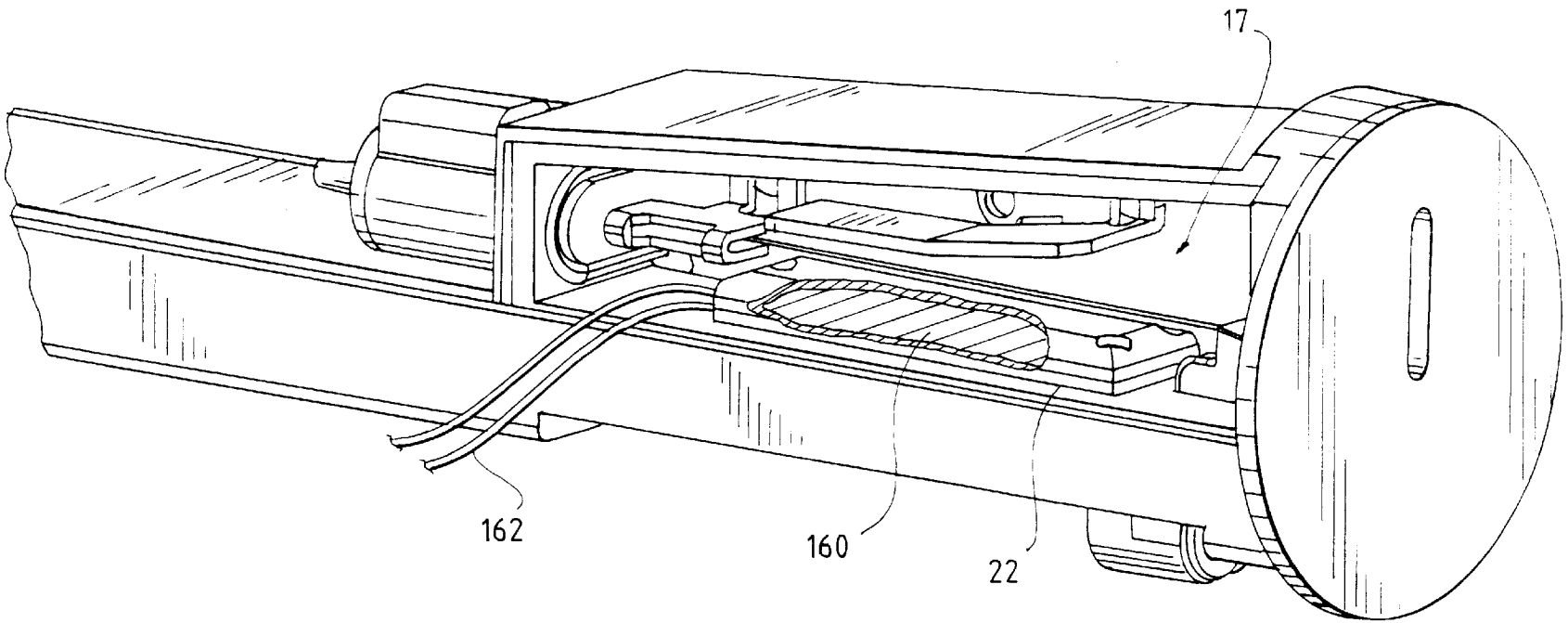
FIG. 7 is a perspective view of the ink jet printhead of FIG. 2 with an electric strip heater installed.

An alternative arrangement for drying the components within compartment 17 is shown in FIG. 7. An electric strip heater, indicated at 160, is built into deflector plate 22 and receives power from a power source (not shown) through wires 162. After the solvent is removed from compartment 17, and the pneumatic shutter is opened, strip heater 160 may be energized so that the surrounding components are dried. It should be noted that strip heater 160 may be placed in various locations within compartment 17.

The drying of the components completes the printhead cleaning cycle. Thereafter the printhead may be returned to service. At this point, both the nozzle and return line have been cleaned by the Auto Flush procedure and the printhead compartment and the components contained therein, have been cleaned by the cleaning process just described.

The valve 105 described in connection with FIG. 5 is of the type disclosed in U.S. Pat. No. 4,555,719 assigned to the present assignee.

As thus described, the invention consists of a cleaning system for an ink jet printhead which can be retrofitted or incorporated into new printheads of the type disclosed to eliminate the need for manual disassembly of the printhead for cleaning the ink deflection components contained in the printhead chamber.

While we have shown and described preferred embodiments of the present invention, it will be understood by those of ordinary skill in the art that changes and modifications can be made without departing from the invention in its broader aspects. Various features of the present invention are set forth in the following claims.

What is claimed:

1. A clean-in-place system for components of an ink jet printhead defining an interior, where the components include electrodes positioned downstream of a nozzle, comprising:

a. a compartment defined within said printhead containing the electrodes, one end of said compartment terminating in an end plate having a slot therethrough to permit ink drops to exit the compartment during normal printing operation;

b. a shutter provided adjacent said slot and having an inflatable member disposed within the interior of the printhead, said inflatable member being inflated to seal said slot or deflatable to unseal said slot;

c. means for operating said shutter to close said slot and seal said compartment;

d. means for introducing an ink solvent to at least partially flood said compartment to dissolve ink which may have deposited on the electrodes; and e. means for removing said solvent and dissolved ink from said compartment.

2. The system of claim 1 wherein said components also include a nozzle face and a catcher for uncharged ink drops, and said electrodes are a charge electrode and deflection electrodes.

3. The system of claim 1 further including:

f. means for agitating the ink solvent in said compartment to enhance contact of the solvent with the components.

4. The system according to claim 3 wherein the means for agitating is a source of compressed air introduced into said compartment and a vent line for communicating said compartment with atmosphere.

5. The system according to claim 1 wherein said means for removing said solvent comprises:

a drain line communicating with said compartment and a source of vacuum for withdrawing said solvent through the drain line.

6. The system according to claim 5 wherein said means for removing solvent further comprises a solvent trap connected to said drain line to receive the solvent.

7. The system according to claim 1 further including:

f. means for introducing air into said compartment to dry said components after removal of said solvent.

8. The system according claim 7 wherein the means for introducing air into said compartment includes means for heating the air before it is introduced into said compartment.

9. The system according to claim 1 further including:

f. means for heating said compartment to dry said components after removal of said solvent.

10. The system according to claim 9 wherein the means for heating said compartment includes an electric strip heater.

11. The system according to claim 10 wherein the electric strip heater is disposed within a deflection electrode positioned within said compartment.

12. The system according to claim 1 wherein means for introducing an ink solvent includes said nozzle for selectively directing both ink and said ink solvent into said compartment.

13. The system according to claim 1 wherein said inflatable member inflates and deflates generally laterally relative to a direction of flow of ink through said chamber.

14. An ink jet printhead defining an interior and including a clean-in-place system comprising:

a) a compartment containing ink jet printing components including electrodes positioned downstream of a nozzle, one end of said compartment terminating in an end plate having a slot therethrough to permit ink drops to exit the compartment during normal printing operation;

b) a pneumatic shutter provided adjacent said slot and having an inflatable member disposed within the interior of the printhead, said inflatable member being inflated to seal said slot or deflatable to unseal said slot;

c) means for operating said shutter to close said slot and seal said compartment;

d) means for introducing an ink solvent to at least partially flood said compartment to dissolve ink which may have deposited on said electrodes; and e) means for removing said solvent and dissolved ink from said compartment.

15. The printhead according to claim 14 further including:

f. means for agitating the ink solvent in said compartment to enhance contact of the solvent with said components.

16. The printhead according to claim 14 wherein said means for removing said solvent comprises:

a drain line communicating with said compartment and a source of vacuum for withdrawing said solvent through the drain line.

17. The printhead according to claim 14 further including:

f. means for introducing air into said compartment to dry said components after removal of said solvent.

18. The printhead according claim 17 wherein the means for introducing air into said compartment includes means for heating the air before it is introduced into said compartment.

19. The printhead according to claim 14 further including:

f. means for heating said compartment to dry said components after removal of said solvent.

20. The printhead according to claim 19 wherein the means for heating said compartment includes an electric strip heater.

21. The printhead according to claim 20 wherein the electric strip heater is disposed within a deflection electrode positioned within said compartment.

22. The printhead according to claim 14 wherein means for introducing an ink solvent includes said nozzle for selectively directing both ink and said ink solvent into said compartment.

23. The printhead according to claim 14 wherein said inflatable member inflates and deflates generally laterally relative to a direction of flow of ink through said chamber.

24. A method for cleaning-in-place the components of an ink jet printhead defining an interior, where the components include electrodes positioned downstream of a nozzle and are contained within a compartment in said printhead terminating in an end plate having an opening therethrough to permit ink drops to exit the compartment during normal printing operation comprising the steps of:

a. providing a shutter adjacent said opening and having an inflatable member disposed within the interior of the printhead, said inflatable member being inflated to seal said slot or deflatable to unseal said slot;

b. operating said shutter to close said opening during cleaning;

c. introducing an ink solvent to, at least, partially flood said compartment to dissolve ink which may have deposited on the electrodes;

d. removing said solvent and dissolved ink from said compartment; and e. operating said shutter to reopen said opening after said solvent has been removed.

25. The method according to claim 24 further including the step of:

f. introducing compressed air into said compartment to dry said components after removal of said solvent.

26. The method according to claim 24 further including the step of:

f. heating said compartment to dry said components after removal of said solvent.

* * * * *

UNITED STATES PATENT AND TRADEMARK OFFICE

CERTIFICATE OF CORRECTION

PATENT NO. : 6,254,216 B1
DATED : March 6, 2001
INVENTOR(S) : Bode, Henry J.

It is certified that error appears in the above-identified patent and that said Letters Patent is hereby corrected as shown below:

Title page,
Item [73], Assignee, change from "Marconi Data Systems, inc." to -- Marconi Data Systems, Inc. --

Signed and Sealed this

Fifth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,254,216 B1
DATED : July 3, 2001
INVENTOR(S) : Arway et al.

It is certified that error appears in the above-identified patent and that said Letters Patent is hereby corrected as shown below:

Title page,
Item [73], Assigness, change from "Marconi Data Systems, inc." to -- Marconi Data Systems, Inc. --.

This certificate supersedes Certificate of Correction issued March 5, 2002.

Signed and Sealed this

Twenty-fifth Day of June, 2002

*Attest:*

*Attesting Officer*

JAMES E. ROGAN
*Director of the United States Patent and Trademark Office*